US006538397B1

(12) United States Patent
Ueno et al.

(10) Patent No.: US 6,538,397 B1
(45) Date of Patent: Mar. 25, 2003

(54) COLOR CATHODE-RAY TUBE APPARATUS

(75) Inventors: Hirofumi Ueno, Fukaya (JP); Tsutomu Takekawa, Fukaya (JP); Noriyuki Miyamoto, Iruma-gun (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 238 days.

(21) Appl. No.: 09/619,580

(22) Filed: Jul. 19, 2000

(30) Foreign Application Priority Data

Aug. 19, 1999 (JP) ..... 11-232069

(51) Int. Cl.[7] ..... G09G 1/04

(52) U.S. Cl. ..... 315/382; 315/368.15; 315/15; 313/447; 313/449

(58) Field of Search ..... 315/14, 15, 368.15, 315/382, 371; 313/412–415, 409, 447–449, 428, 452

(56) References Cited

U.S. PATENT DOCUMENTS 4,771,216 A * 9/1988 Blacker et al. ..... 315/15
5,113,112 A * 5/1992 Shimoma et al. ..... 313/412
5,412,277 A * 5/1995 Chen ..... 313/412
5,414,323 A * 5/1995 Ushida et al. ..... 313/414
5,488,265 A * 1/1996 Chen ..... 313/412
5,610,475 A * 3/1997 Chen ..... 313/412
5,847,500 A * 12/1998 Mera et al. ..... 313/412
6,051,919 A * 4/2000 Shirai et al. ..... 313/412
6,339,284 B1 * 1/2002 Takekawa et al. ..... 313/414

FOREIGN PATENT DOCUMENTS

JP 64-038947 2/1989

* cited by examiner

*Primary Examiner*—Haissa Philogene
(74) *Attorney, Agent, or Firm*—Oblon, Spivak, McClelland, Maier & Neustadt, P.C.

(57) ABSTRACT

A color cathode-ray tube apparatus comprises an electron gun structure having a plurality of electrodes for constituting a plurality of electron lenses including a main lens for focusing an electron beam on a phosphor screen, and a deflection yoke for producing deflection magnetic fields for deflecting the electron beam emitted from the electron gun structure in a horizontal direction and a vertical direction. An electron beam passage hole formed in at least one of the electrodes constituting the main lens has a waist portion substantially acting on formation of the electron lenses. The waist portion minimizes a horizontal dimension of a region where the electron beam passes.

10 Claims, 10 Drawing Sheets

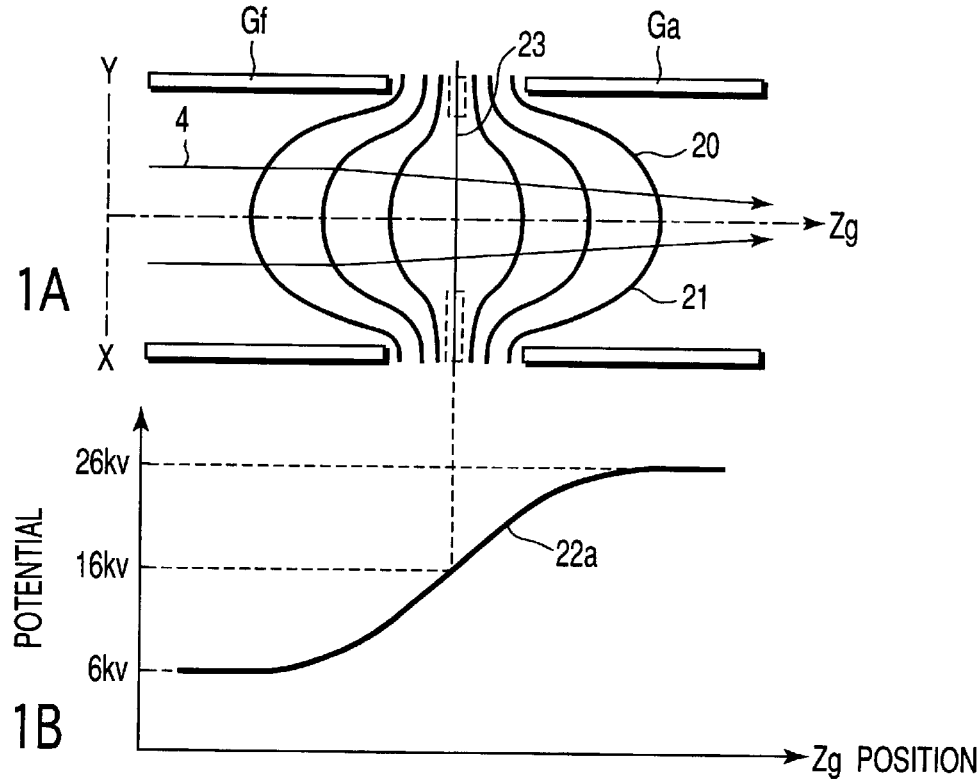
FIG. 1A
FIG. 1B
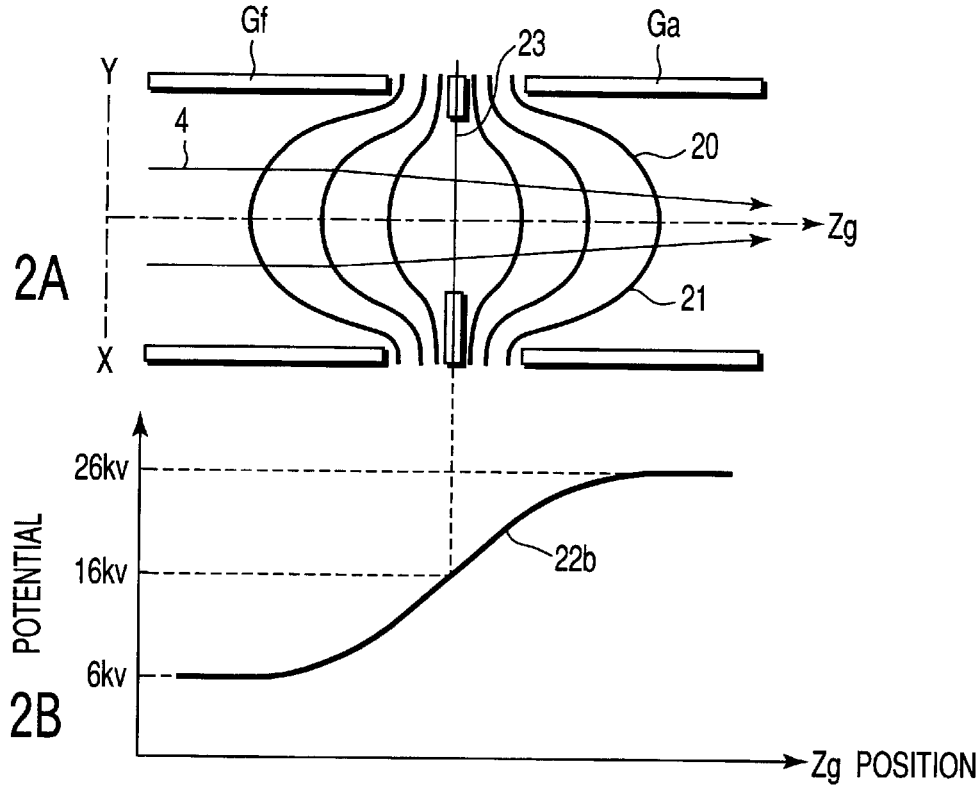
FIG. 2A
FIG. 2B

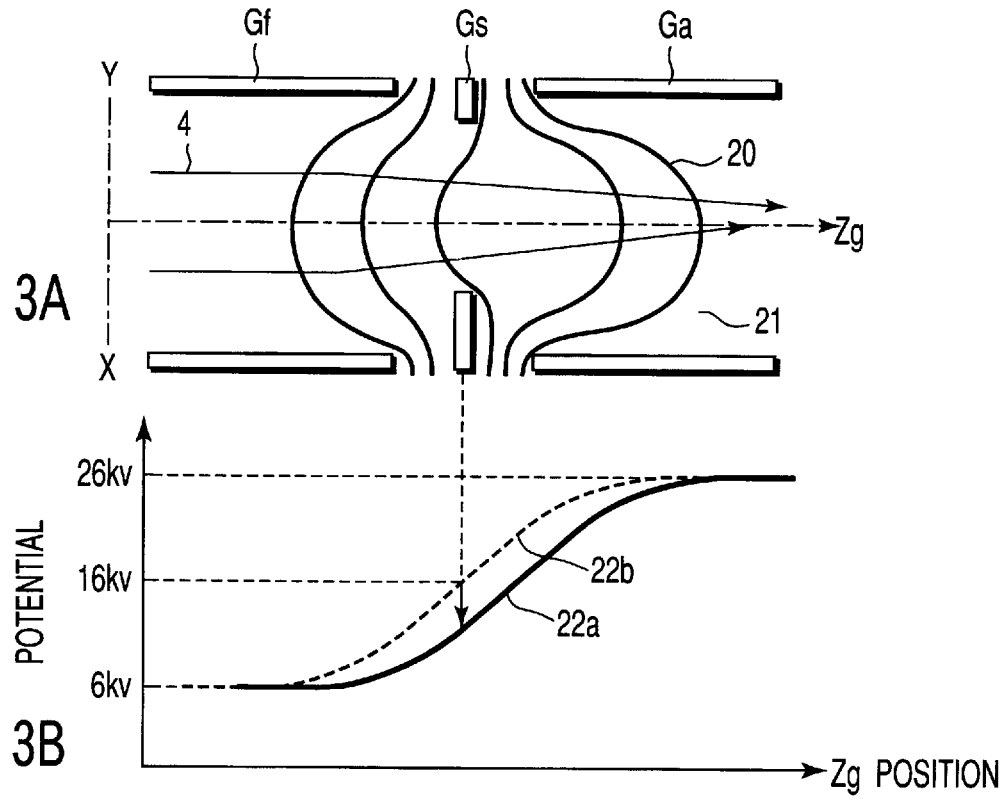
FIG. 3A
FIG. 3B
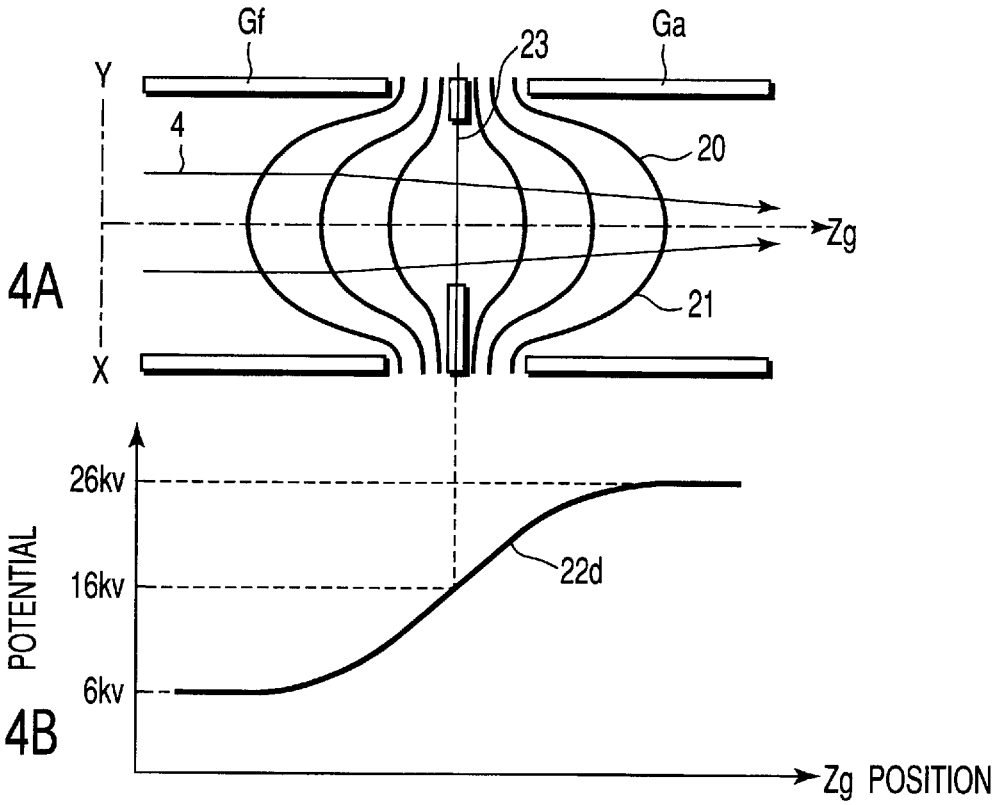
FIG. 4A
FIG. 4B

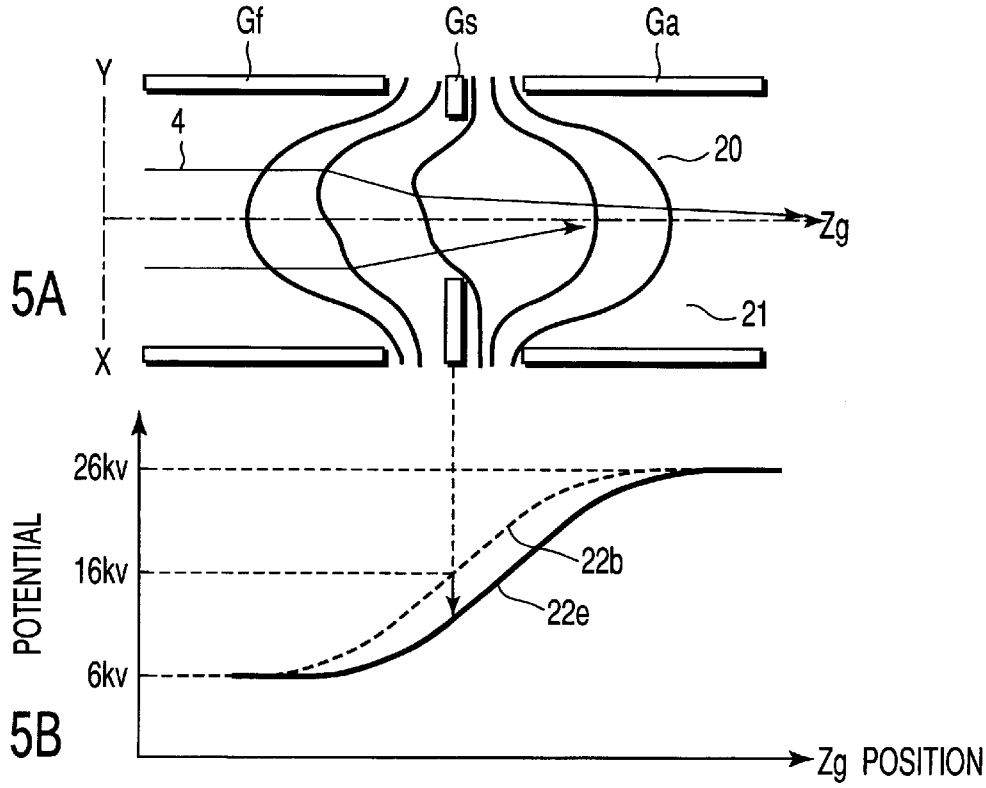
FIG. 5A
FIG. 5B
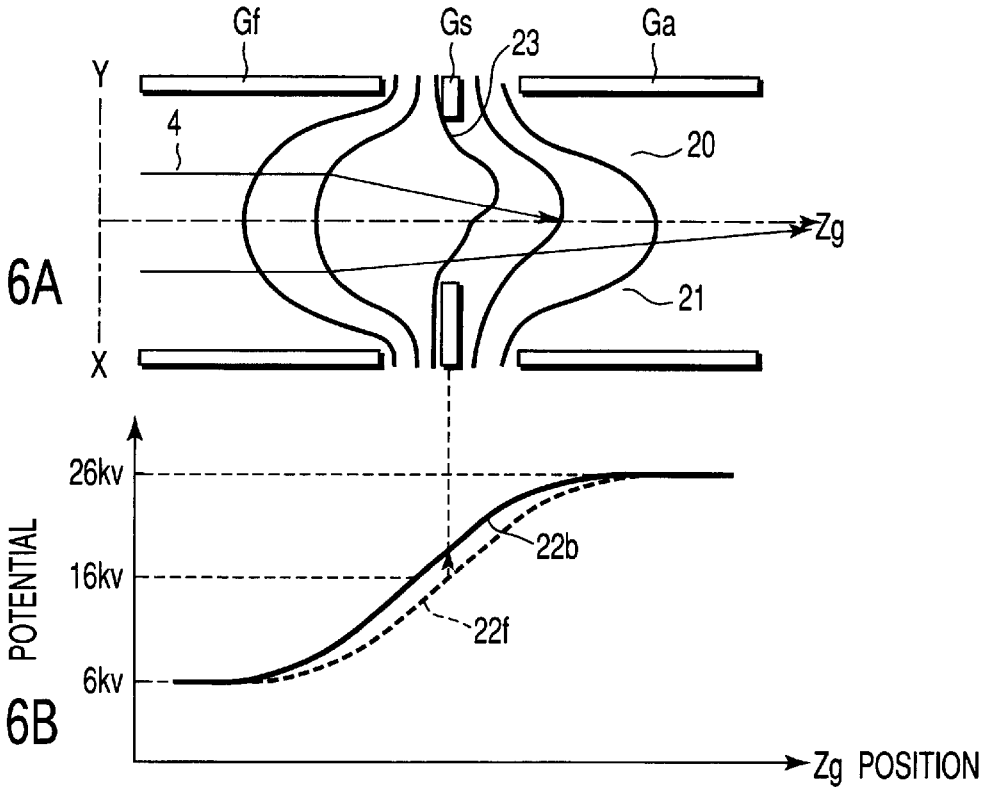
FIG. 6A
FIG. 6B

COLOR CATHODE-RAY TUBE APPARATUS

CROSS-REFERENCE TO RELATED APPLICATIONS

This application is based upon and claims the benefit of priority from the prior Japanese Patent Application No. 11-232069, filed Aug. 19, 1999, the entire contents of which are incorporated herein by reference.

BACKGROUND OF THE INVENTION

The present invention relates to a color cathoderay tube (CRT) apparatus, and more particularly to a color CRT apparatus capable of displaying a high-quality image, with reduction in oval deformation of a beam spot on a peripheral portion of a screen.

Self-convergence in-line type color CRT apparatuses, each having an electron gun structure with a BPF (Bi-Potential Focus) type DAC&F (Dynamic Astigmatism Correction and Focus) system, have now been widely used.

The electron gun structure with the BPF type DAC&F system, as shown in FIG. 13, comprises three cathodes K arranged in line; a first grid G1; a second grid G2; a third grid G3 having two segments G31 and G32; and a fourth grid G4. The grids G1 to G4 are disposed in the named order from the cathodes (K) side toward a phosphor screen. Each grid has three in-line electron beam passage holes which are formed in association with the three cathodes K.

A voltage obtained by superimposing video signals upon a voltage of about 150 V is applied to the cathodes K. The first grid G1 is grounded. A voltage of about 600 V is applied to the second grid G2. A DC voltage of about 6 kV is applied to the first segment G31 of the third grid G3. A dynamic voltage obtained by superimposing a parabolic AC voltage component, which increases in accordance with an increase in the degree of deflection of an electron beam, upon a DC voltage of about 6 kV, is applied to the second segment G32 of the third grid G3. A voltage of about 26 kV is applied to the fourth grid G4.

An electron beam generating unit is constituted by the cathodes K, first grid G1 and second grid G2. The electron beam generating unit generates electron beams and forms an object point for a main lens. A prefocus lens is constituted by the second grid G2 and the first segment G31 and it prefocuses the electron beams generated from the electron beam generating unit. A BPF type main lens is constituted by the second segment G32 and the fourth grid G4. The BPF type main lens accelerates the prefocused electron beams toward the phosphor screen and ultimately focuses them on the phosphor screen.

Where electron beams are deflected onto a corner portion of the phosphor screen, a potential difference between the second segment G32 and the fourth grid G4 takes a minimum value and the intensity of the main lens formed therebetween lowers to a minimum. At the same time, a maximum potential difference is provided between the first segment G31 and the second segment G32, and a quadrupole lens is formed which has a focusing function in a horizontal direction and a divergence function in a vertical direction. At this time, the intensity of the quadrupole lens takes a maximum value.

Where the electron beams are deflected onto a corner portion on the phosphor screen, a distance between the electron gun structure and the phosphor screen becomes longest and an image point is formed at a farther position. In the case of the electron gun structure with the above-described BPF type DAC&F system, the formation of the image point at a farther position is compensated by decreasing the intensity of the main lens. In addition, a deflection aberration caused by a pin-cushion-shaped horizontal deflection magnetic field and a barrel-shaped vertical deflection magnetic field of a deflection yoke is compensated by the formation of a quadrupole lens.

In order to enhance the image quality in the color CRT apparatus, it is necessary to improve the focusing characteristics and beam spot shape on the phosphor screen. In the conventional in-line type color CRT apparatus, as shown in FIG. 14A, a beam spot 1 formed on a central area of the phosphor screen is circular but a beam spot 1 formed on a peripheral area extending from an end of a horizontal axis (X-axis) to an end of a diagonal axis (D-axis) is deformed in an oval shape along a horizontal axis (X-axis) ("horizontal deformation") due to deflection aberration and a blur 2 occurs along a vertical axis (Y-axis). The image quality is thus degraded.

In order to solve this problem, in the electron gun structure with the BPF type DAC&F system, the low-voltage-side grid constituting the main lens is composed of a plurality of segments, like the third grid G3, and a quadrupole lens which has a lens intensity varying dynamically in accordance with a deflection amount of the electron beam is formed between the segments. Accordingly, the blur 2 of the beam spot 1 is eliminated, as shown in FIG. 14B.

However, in the electron gun structure with the BPF type DAC&F system, too, horizontal deformation occurs in the beam spot 1 formed on the peripheral area extending from the end of the horizontal axis (X-axis) to the end of the diagonal axis (D-axis), as shown in FIG. 14B. The horizontal deformation of the beam spot 1 occurs because the electron gun structure is of the in-line type, the horizontal deflection magnetic field generated by the deflection yoke has a pin-cushion shape, and the vertical deflection magnetic field generated by the same has a barrel shape.

The horizontal deformation of the beam spot 1 will now be explained with reference to optical models shown in FIGS. 15A and 15B. In FIGS. 15A and 15B, an upperside portion of a tube axis (Z-axis) corresponds to a cross-sectional view taken along a vertical axis (Y-axis), and a lower-side portion of the tube axis corresponds to a cross-sectional view taken along a horizontal axis (X-axis). FIG. 15A shows an optical model wherein an electron beam 4 is made incident on a central portion of a phosphor screen 5, without being deflected. FIG. 15B shows an optical model wherein the electron beam 4 is deflected and made incident on a peripheral portion of the phosphor screen 5. In these figures, ML denotes a main lens, QL denotes a quadrupole lens, and DL denotes a quadrupole lens component formed by deflection magnetic fields.

In general, the size of the beam spot 1 on the phosphor screen varies depending on a magnification M. The magnification M is expressed by a ratio of a divergence angle $\alpha 0$ of the electron beam 4 to an incidence angle $\alpha i$ on the phosphor screen:

$\alpha 0/\alpha i$.

Where a horizontal divergence angle is $\alpha 0h1$, a horizontal incidence angle is $\alpha ih1$, a vertical divergence angle $\alpha 0v1$ and a vertical incidence angle $\alpha iv1$, a horizontal magnification Mh1 and a vertical magnification Mv1 are given by $Mh1=\alpha 0h1/\alpha ih1$ $Mv1=\alpha 0v1/\alpha iv1$.

Accordingly, where $\alpha 0h1=\alpha 0v1$, the following equation is obtained at the time of non-deflection, as shown in FIG.

15A, by the main lens ML having uniform focusing functions mainly in the horizontal and vertical directions:

$\alpha ih1=\alpha iv1$.

Therefore, Mh1=Mv1, and a circular beam spot is formed on a central portion of the phosphor screen.

On the other hand, at the time of deflection, as shown in FIG. 15B, in order to compensate the quadrupole lens component DL of the deflection fields having a diverging function in the horizontal direction and a focusing function in the vertical direction, the quadrupole lens QL having a focusing function in the horizontal direction and a diverging function in the vertical direction is formed in front of the main lens ML. Accordingly, $\alpha ih1<\alpha iv1$ and Mh1>Mv1.

Thus, an oval beam spot is formed on a peripheral portion of the phosphor screen.

As has been described above, in order to enhance the image quality of the color CRT apparatus, the focusing characteristics and beam spot shape on the phosphor screen need to be improved.

With the conventional electron gun structure of the BPF type DAC&F system, a vertical blue of the beam spot due to deflection aberration is eliminated and the beams are focused over the entire area of the phosphor screen. However, in the case of the conventional electron gun structure of the BPF type DAC&F system, horizontal deformation of the beam spot formed on a peripheral area extending from an end of the horizontal axis to an end of the diagonal axis on the phosphor screen cannot be eliminated. Consequently, the horizontal deformation of the beam spot interferes with the electron beam passage holes in the shadow mask, thus causing moire, etc. and degrading the quality of display images such as characters.

BRIEF SUMMARY OF THE INVENTION

The present invention has been made in order to overcome the above problems, and the object of the invention is to provide a color cathode-ray tube capable of achieving optimal focusing over an entire screen and displaying a high-quality image, while reducing an oval deformation of a beam spot on a peripheral area of the screen.

According to the present invention, in order to achieve the above object, there is provided a color cathode-ray tube apparatus comprising:

an electron gun structure having a plurality of electrodes for constituting a plurality of electron lenses including a main lens for focusing an electron beam on a phosphor screen; and a deflection yoke for producing deflection magnetic fields for deflecting the electron beam emitted from the electron gun structure in a horizontal direction and a vertical direction, wherein an electron beam passage hole formed in at least one of the electrodes constituting the main lens has a waist portion substantially acting on formation of the electron lenses, the waist portion minimizing a horizontal dimension of a region where the electron beam passes.

According to the present invention, there is also provided a color cathode-ray tube apparatus comprising:

an electron gun structure having a plurality of electrodes for constituting a plurality of electron lenses including a main lens for focusing an electron beam on a phosphor screen; and a deflection yoke for producing deflection magnetic fields for deflecting the electron beam emitted from the electron gun structure in a horizontal direction and a vertical direction, wherein an electron beam passage hole formed in at least one of the electrodes constituting the main lens has a waist portion substantially acting on formation of the electron lenses, the waist portion minimizing a vertical dimension of a region where the electron beam passes.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 1A shows an electric field of a rotation-symmetric BPF main lens;

FIG. 1B shows a potential along center axes of electrodes constituting the main lens shown in FIG. 1A;

FIG. 2A shows an electric field produced in a case where an additional electrode is disposed at a geometrical center of the main lens shown in FIG. 1A;

FIG. 2B shows a potential along center axes of electrodes constituting the main lens shown in FIG. 2A;

FIG. 3A shows an electric field produced in a case where an application voltage to the additional electrode shown in FIG. 2A is decreased to less than 16 kV;

FIG. 3B shows a potential along center axes of electrodes constituting the main lens shown in FIG. 3A;

FIG. 4A shows an electric field produced in a case where the additional electrode shown in FIG. 2A is provided with waist portions which minimize horizontal dimensions of electron beam passage holes in the additional electrode;

FIG. 4B shows a potential along center axes of electrodes constituting the main lens shown in FIG. 4A;

FIG. 5A shows an electric field produced in a case where an application voltage to the additional electrode shown in FIG. 4A is decreased to less than 16 kV;

FIG. 5B shows a potential along center axes of electrodes constituting the main lens shown in FIG. 5A;

FIG. 6A shows an electric field produced in a case where an application voltage to the additional electrode shown in FIG. 4A is increased to more than 16 kV;

FIG. 6B shows a potential along center axes of electrodes constituting the main lens shown in FIG. 6A;

DETAILED DESCRIPTION OF THE INVENTION

Figure 7:
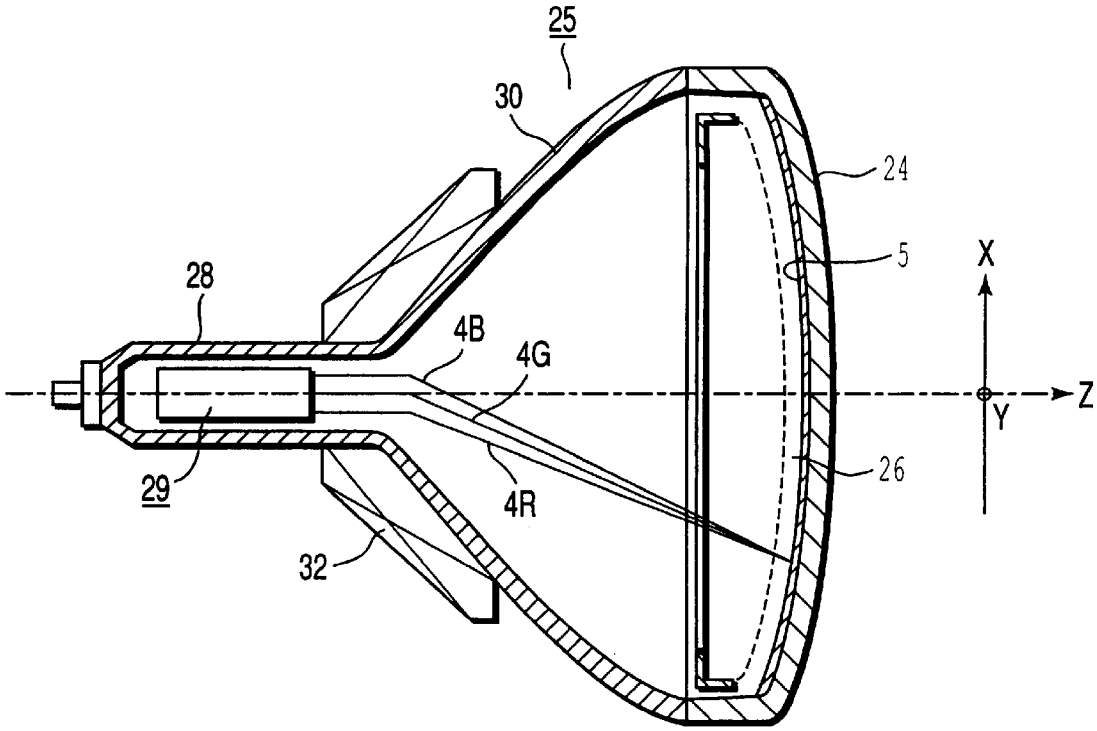
FIG. 7 is a horizontal cross-sectional view schematically showing the structure of a color CRT apparatus according to an embodiment of the present invention.

Embodiments of the color cathode-ray tube (CRT) apparatus according to the present invention will now be described with reference to the accompanying drawings.

A description will be given of a method of forming a quadrupole lens with an adequate lens intensity within a main lens for ultimately accelerating and focusing an electron beam on a phosphor screen.

To begin with, a general rotation-symmetric BPF type main lens will be described.

The rotation-symmetric BPF-type lens is formed by an electric field 21 which is symmetric in a horizontal direction (X) and a vertical direction (Y), as indicated by equipotential surfaces 20 in FIG. 1A. This main lens focuses an electron beam 4 in the horizontal and vertical directions with an equal focusing power. As is indicated by a curve 22*a* in FIG. 1B, a potential (axial potential) on a center axis Zg of a focus electrode Gf and an anode electrode Ga constituting the main lens increases in the direction of traveling of the electron beam 4. In this case, for example, if an application voltage to the focus electrode Gf is 6 kV and an application voltage to the anode electrode Ga is 26 kV, an equipotential surface 23 formed at a geometrical center of the main lens (an equidistant position from the focus electrode and anode electrode) is planar and has a potential of 16 kV.

A description will now be given of a case where an additional electrode Gs is disposed at the geometrical center of the main lens, as shown in FIG. 2A. The additional electrode Gs is formed of a plate-like electrode having vertically elongated electron passage holes each having a long axis in the vertical direction. Where a voltage of 6 kV is applied to the focus electrode Gf and a voltage of 26 kV is applied to the anode electrode Ga, a potential of 16 kV is applied to the additional electrode Gs. In this case, as indicated by a curve 22*b* in FIG. 2B, an axial potential of the main lens has the same potential distribution as with the case where the additional electrode is not provided, as shown in FIG. 1B. Accordingly, this main lens focuses the electron beam 4 in the horizontal and vertical directions with an equal focusing power.

A description will now be given of a case where a voltage lower than 16 kV is applied to the additional electrode Gs. As is shown in FIG. 3A, an anode electrode (Ga)-side potential of the additional electrode Gs permeates to the focus electrode (Gf) side via the electron beam passage hole in the additional electrode Gs. Thereby, an aperture lens (quadrupole lens) is formed within the main lens. In this case, an axial potential of the main lens varies as indicated by a curve 22*c* in FIG. 3B. Since the electron beam passage hole in the additional electrode Gs is vertically elongated, the aperture lens formed within the main lens has a relatively high focusing power on the electron beam 4 in the horizontal direction and a relatively low focusing power on the electron beam 4 in the vertical direction. Specifically, the main lens has an astigmatism. However, since the aperture lens focuses the electron beam both in the horizontal and vertical directions, a sufficiently high astigmatism cannot be created.

On the other hand, a description will now be given of a case, as shown in FIG. 4A, where the electron beam passage hole is provided with a waist portion for minimizing a horizontal dimension thereof, thereby to form an electron lens acting on the electron beam 4 passing through the electron beam passage hole. Specifically, the additional electrode Gs disposed at a geometrical center of the rotation-symmetric BPF type main lens has a vertically elongated electron beam passage hole. This non-circular electron beam passage hole has the waist portion for minimizing the horizontal dimension of the region where the electron beam 4 passes. Where the application voltage to the focus electrode Gf is 6 kV, the application voltage to the additional electrode Gs is 16 kV and the application voltage to the anode electrode is 26 kV, the main lens with this structure has the same potential distribution, as indicated by a curve 22*d* in FIG. 4B, as the axial potential of the main lens shown in FIG. 2B. Accordingly, this main lens, like the main lens with no additional electrode, focuses the electron beam in the horizontal and vertical directions with an equal focusing power.

A description will now be given of a case where a voltage lower than 16 kV is applied to the additional electrode Gs. As is shown in FIG. 5A, an anode electrode (Ga)-side potential of the additional electrode Gs permeates to the focus electrode (Gf) side via the electron beam passage hole in the additional electrode Gs. Thereby, an aperture lens (quadrupole lens) is formed within the main lens. In this case, an axial potential of the main lens varies as indicated by a curve 22*e* in FIG. 5B. Since the electron beam passage hole in the additional electrode Gs has the waist portion, the potential permeating via the electron beam passage hole has an equipotential surface, as shown in FIG. 5A. Specifically, with respect to the horizontal direction (X), the equipotential surface permeates to the focus electrode (Gf) side, gradually from a peripheral region of the electron beam passage hole toward the center axis Zg, and it permeates to a maximum degree near the center axis Zg. On the other hand, with respect to the vertical direction (Y), the equipotential surface permeates to a maximum degree to the focus electrode (Gf) side, at a point en-route from a peripheral region of the electron beam passage hole toward the center axis Zg, and the degree of permeation gradually decreases near the center axis Zg. As a result, the aperture lens (quadrupole lens) formed by the permeation of potential has a focusing power on the electron beam 4 in the horizontal direction and a diverging power in the vertical direction. Thus, the main lens can cause a sufficiently high strong astigmatism.

A description will now be given of a case where a voltage higher than 16 kV is applied to the additional electrode Gs. As is shown in FIG. 6A, a focus electrode (Gf)-side potential of the additional electrode Gs permeates to the anode electrode (Ga) side via the electron beam passage hole in the additional electrode Gs. In this case, an axial potential of the main lens varies as indicated by a curve 22*f* in FIG. 6B. Since the electron beam passage hole in the additional electrode Gs has the waist portion, the potential permeating via the electron beam passage hole has an equipotential surface, as shown in FIG. 6A. Specifically, with respect to the horizontal direction, the equipotential surface permeates to the anode electrode (Ga) side, gradually from a peripheral region of the electron beam passage hole toward the center axis Zg, and it permeates to a maximum degree near the center axis Zg. On the other hand, with respect to the vertical direction, the equipotential surface permeates to a maximum degree to the anode electrode (Ga) side, at a point en-route from a peripheral region of the electron beam passage hole toward the center axis Zg, and the degree of permeation gradually decreases near the center axis Zg. As a result, the aperture lens (quadrupole lens) formed by the permeation of potential has a focusing power on the electron beam 4 in the vertical direction and a diverging power in the horizontal direction. Thus, the main lens can cause a sufficiently high strong astigmatism.

In brief, the rotation-symmetric BPF type main lens according to this embodiment has the additional electrode Gs disposed at the geometrical center of the main lens. The additional electrode Gs has the elongated electron beam passage hole which has the long axis in the vertical direction (Y-direction). This non-circular electron beam passage hole has the waist portion for minimizing the horizontal dimension of the region where the electron beam 4 passes, thereby forming the electron lens acting on the passing electron beam. If a dynamically varying voltage, which is higher than a voltage applied to the focus electrode Gf and lower than a voltage applied to the anode electrode Ga, is applied to the additional electrode Gs, an astigmatism for controlling the focusing power in the horizontal direction and the focusing power in the vertical direction can be created without degrading the aperture of the main lens.

The above description is directed to the case where the voltage applied to the additional electrode is varied. However, instead of varying the voltage to the additional electrode, the value expressed by the formula below may be varied to obtain the same result:

[(application voltage to the additional electrode)−(application voltage to the focus electrode)]/[(application voltage to the anode electrode)−(application voltage to the focus electrode)]

The embodiment of the present invention will now be described more specifically by referring to examples.

EXAMPLE 1

As is shown in FIG. 7, an, in-line type color CRT apparatus has an envelope comprising a panel 24, a neck 28 and a funnel 25 which integrally couples the panel 24 and neck 28. The panel 24 has, on its inner surface, a phosphor screen 5 composed of a three-color phosphor layer which emits blue, green and red. A shadow mask 26, which has a great number of electron beam passage holes on its inside, is disposed to be opposed to the phosphor screen 5. The neck 28 includes an in-line type electron gun structure 29. The electron gun structure 29 emits three in-line electron beams 4B, 4G and 4R, that is, a center beam 4G and a pair of side beams 4B and 4R, which travel in the same horizontal plane. A deflection yoke 32 is mounted on a region extending from a large-diameter portion 30 of the funnel 25 to the neck 28. The deflection yoke 32 generates non-uniform deflection magnetic fields for deflecting the three electron beams 4B, 4G and 4R emitted from the electron gun structure 29 in a horizontal direction (X) and a vertical direction (Y). The non-uniform deflection magnetic fields comprise a pin-cushion-shaped horizontal deflection magnetic field and a barrel-shaped vertical deflection magnetic field.

The three electron beams 4B, 4G and 4R emitted from the electron gun structure 29 are deflected by the non-uniform deflection fields generated by the deflection yoke 32 and horizontally and vertically scanned over the phosphor screen 5 via the shadow mask 26. Thereby, color images are displayed.

Figure 8:
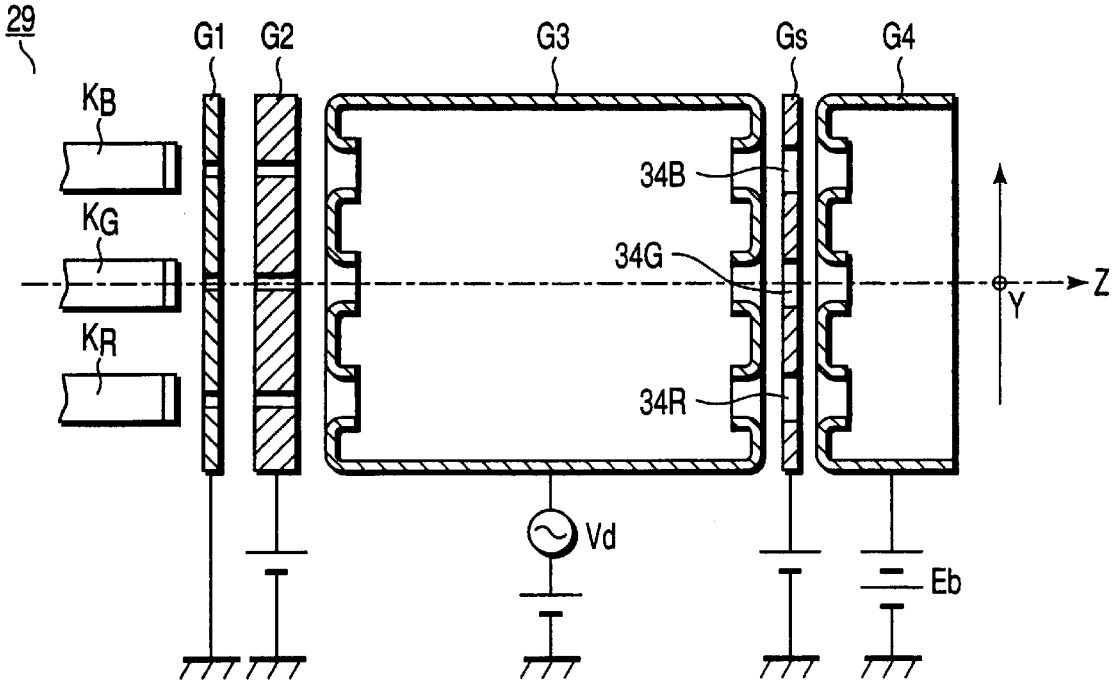
FIG. 8 is a horizontal cross-sectional view schematically showing the structure of an electron gun structure according to Example 1, which is applied to the color CRT apparatus shown in FIG. 7.

As is shown in FIG. 8, the electron gun structure 29 comprises three cathodes K arranged in line in the horizontal direction (X); three heaters (not shown) for individually heating the cathodes K; and five electrodes. The five electrodes are a first grid G1; a second grid G2; a third grid G3; an additional electrode Gs; and a fourth grid G4. The five electrodes G1, G2, G3, Gs and G4 are disposed in the named order from the cathodes (K) side toward the phosphor screen. The heaters, cathodes K and five electrodes are integrally fixed by a pair of insulating support members (not shown).

The first and second grids G1 and G2 are composed of integral plate-like electrodes, respectively. These plate-like electrodes have three in-line circular electron beam passage holes formed in the horizontal direction in association with the three cathodes K. The third grid G3 is composed of an integral cylindrical electrode. This cylindrical electrode has, in its both end faces, i.e. in its faces opposed to the second grid G2 and additional electrode Gs, three in-line circular electron beam passage holes formed in the horizontal direction in association with the three cathodes K. The fourth grid G4 is composed of an integral cup-shaped electrode. The cup-shaped electrode has, in its end face opposed to the additional grid Gs, three in-line circular electron beam passage holes formed in the horizontal direction in association with the three cathodes K.

Figure 9:
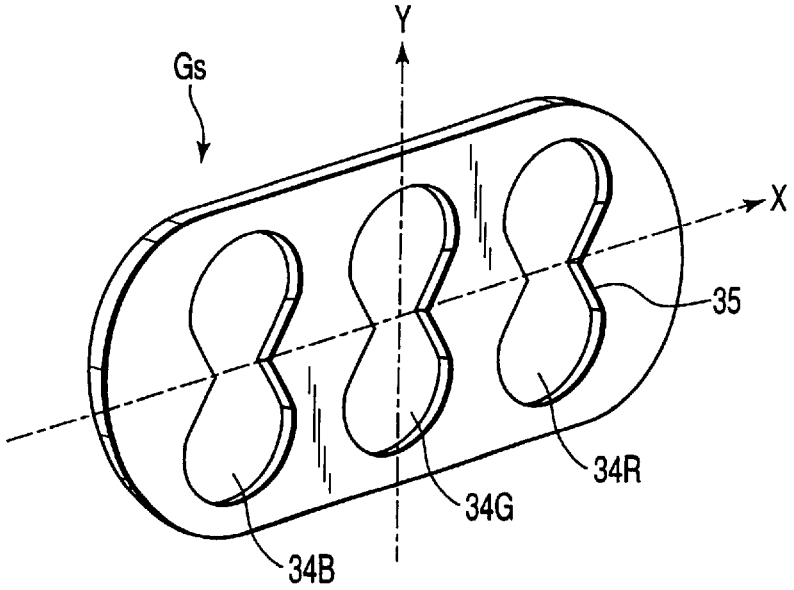
FIG. 9 is a perspective view showing the shape of each electron beam passage hole formed in the additional electrode in the electron gun structure shown in FIG. 8.
Figure 16:
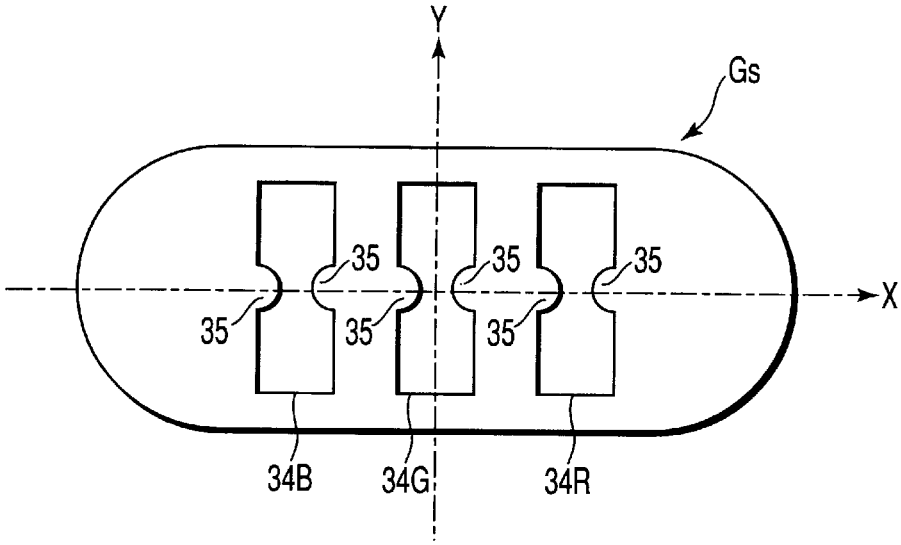
FIG. 16 shows another shape of each electron beam passage hole formed in the additional electrode applicable to the color CRT apparatus according to Example 1.
Figure 17:
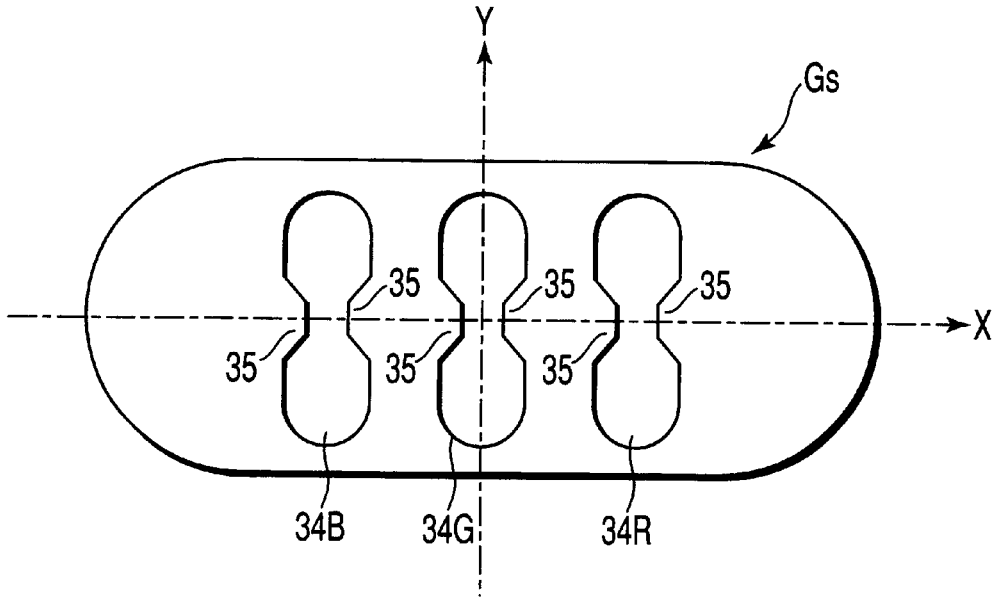
FIG. 17 shows another shape of each electron beam passage hole formed in the additional electrode applicable to the color CRT apparatus according to Example 1.

The additional electrode Gs is disposed at a geometrical center between the third grid G3 and fourth grid G4, i.e. at a position equidistant from the third grid G3 and fourth grid G4. As is shown in FIG. 9, the additional electrode Gs is an integral plate-like electrode having three in-line non-circular electron beam passage holes 34R, 34G and 34B which have long axes in the vertical direction (Y) and are arranged in the horizontal direction in association with the three cathodes K. Each of these electron beam passage holes 34 has a waist portion 35 which minimizes a horizontal dimension of a region where the electron beam passes. The waist portion 35 contributes to the formation of the electron lens acting on the electron beam passing through the electron beam passage hole 34. The electron beam passage holes formed in the additional electrode Gs may have shapes as shown in FIGS. 16 and 17.

Figure 18:
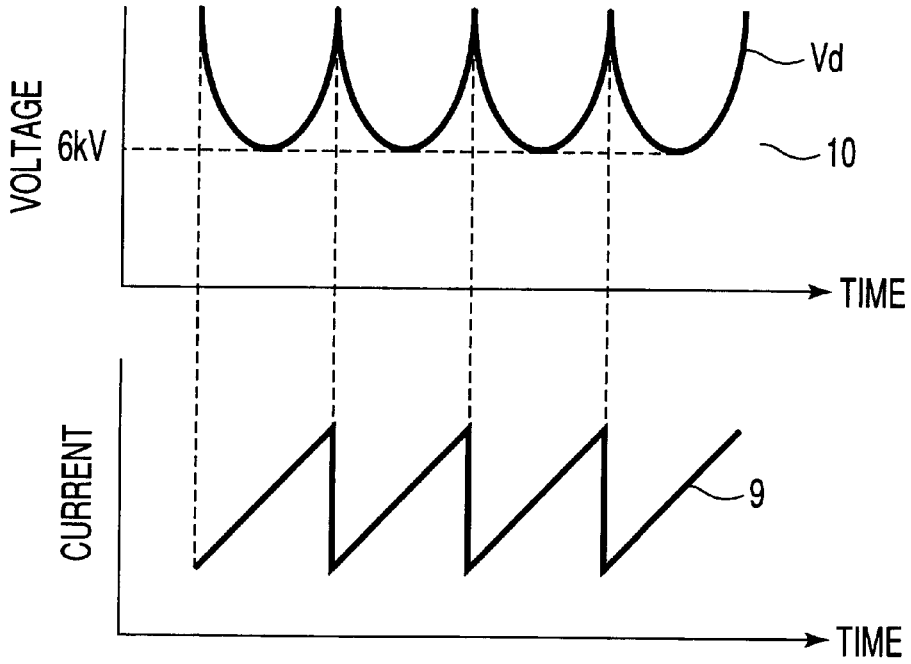
FIG. 18 shows a relationship between a dynamic voltage applied to a third grid of the electron gun structure according to Embodiments 1 and 2, and a deflection current applied to a deflection yoke.

In the electron gun structure 29 having the above structure, a voltage obtained by superimposing video signals upon a DC voltage of 150 V is applied to the cathodes K. The first grid G1 is grounded. A DC voltage of about 600 V is applied to the second grid G2. A dynamic voltage 10, which is obtained by superimposing a parabolically variable AC voltage component Vd upon a DC voltage of about 6 kV, as shown in FIG. 18, is applied to the third grid G3. The AC voltage component Vd is synchronized with a sawtooth deflection current 9 and increases in a parabolic fashion in accordance with an increase in the degree of deflection of the electron beam. An anode voltage Eb of about 26 kV is applied to the fourth grid G4. A DC voltage of about 16 kV is applied to the additional electrode Gs.

With the application of the voltages to the respective grids, the electron gun structure 29 forms an electron beam generating unit, a prefocus lens and a main lens. The electron beam generating unit is constituted by the cathodes K, first grid G1 and second grid G2. The electron beam generating unit generates electron beams and forms an object point for the main lens. The prefocus lens is constituted by the second grid G2 and the third grid G3 and it prefocuses the electron beams generated from the electron beam generating unit. The main lens is constituted by the third grid G3 (focus electrode), the additional electrode Gs and the fourth grid G4 (anode electrode). The main lens ultimately focuses the electron beams, which have been prefocused by the prefocus lens, onto the phosphor screen. At the time of deflection, a quadrupole lens is formed within the main lens by the additional electrode Gs disposed between the third grid G3 and fourth grid G4.

At the time of non-deflection when the electron beams 4B, 4G and 4R are focused at a central portion on the phosphor screen 5, the main lens is formed by the electric field 21 as shown in FIG. 4A and thus it has no astigmatism. Accordingly, each electron beam 4B, 4G, 4R is focused in the horizontal and vertical directions with an equal focusing power. Thus, each electron beam 4B, 4G, 4R is focused at a central portion on the phosphor screen 5 so as to have a substantially circular beam spot.

At the time of deflection when each electron beam 4B, 4G, 4R is deflected toward a peripheral portion on the phosphor screen 5, the dynamic voltage 10 applied to the third grid G3 increases as the amount of deflection of the electron beam increases. At this time, compared to the time of non-deflection, the value expressed by the formula below decreases:

[(application voltage to the additional electrode)−(application voltage to the third electrode)]/[(application voltage to the fourth electrode)−(application voltage to the third electrode)], i.e.,

[(application voltage to the additional electrode)−(application voltage to the focus electrode)]/[(application voltage to the anode electrode)−(application voltage to the focus electrode)]

In this case, since each of the electron beam passage holes 34B, 34G and 34R in the additional electrode Gs has the waist portion 35, the main lens is formed by the electric field as shown in FIG. 5A. Accordingly, the main lens has astigmatism. Specifically, an aperture lens (quadrupole lens) having a focusing function in the horizontal direction and a divergence function in the vertical direction is formed within the main lens. At the same time, a potential difference between the third grid G3 and fourth grid G4 decreases. Thereby, the horizontal focusing force and vertical focusing force of the main lens are decreased.

In this electron gun structure 29, the main lens including the quadrupole lens is constructed such that the focusing force intensified by the waist portion 35 of additional electrode Gs and the focusing force weakened by the decrease in potential difference between the third grid G3 and fourth grid G4 cancel each other in the horizontal direction.

In addition, in this electron gun structure 29, the main lens has a relative divergence function in the vertical direction, owing to the divergence force produced by the waist portion 35 of the additional electrode Gs and the focusing force weakened by the decrease in potential difference between the third grid G3 and fourth grid G4.

As described above, at the time of deflection, the main lens has astigmatism. That is, the main lens has a relatively weak focusing force in the horizontal direction and a divergence force in the vertical direction. Thereby, the electron beams are optically focused on the phosphor screen 5, and the beam spot shape of each electron beam can be improved and made substantially circular.

Where the main lens is formed by the third grid G3 and fourth grid G4 as an electron lens having a stronger focusing force in the horizontal direction than in the vertical direction, the same advantage can be obtained by setting, at the time of non-deflection, the application voltage to the additional electrode Gs to be less than 16 kV (that is, by applying a potential, which is lower than a potential at the geometrical center of the main lens, to the additional electrode Gs).

EXAMPLE 2

Figure 10:
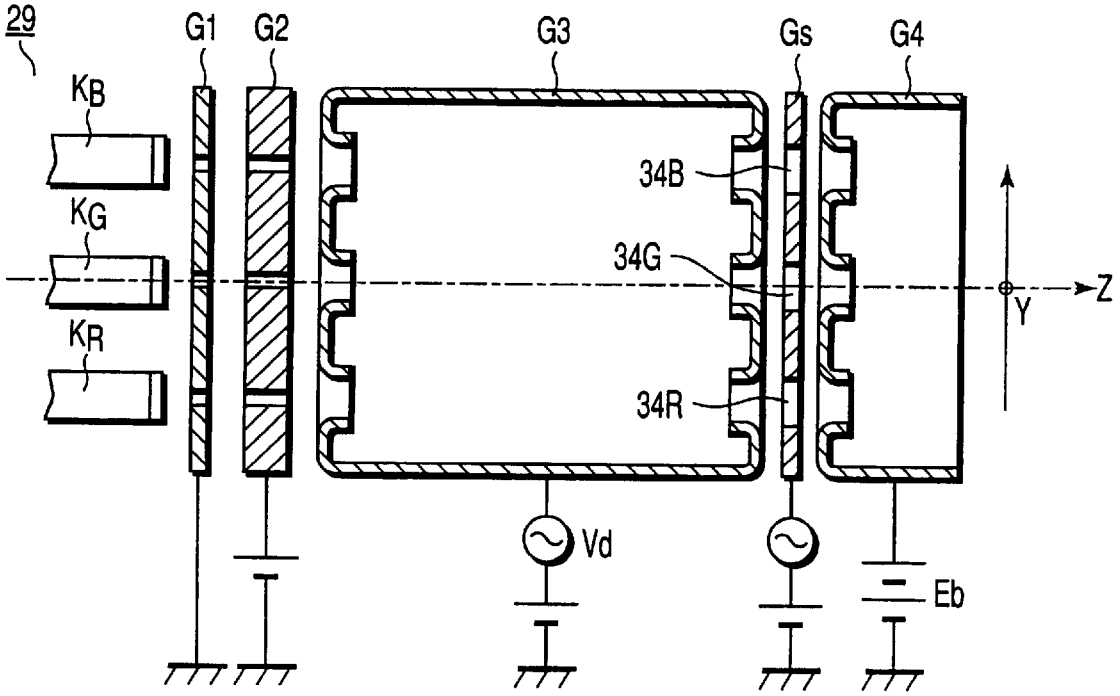
FIG. 10 is a horizontal cross-sectional view schematically showing the structure of an electron gun structure according to Example 1, which is applied to the color CRT apparatus shown in FIG. 7.
Figure 11A:
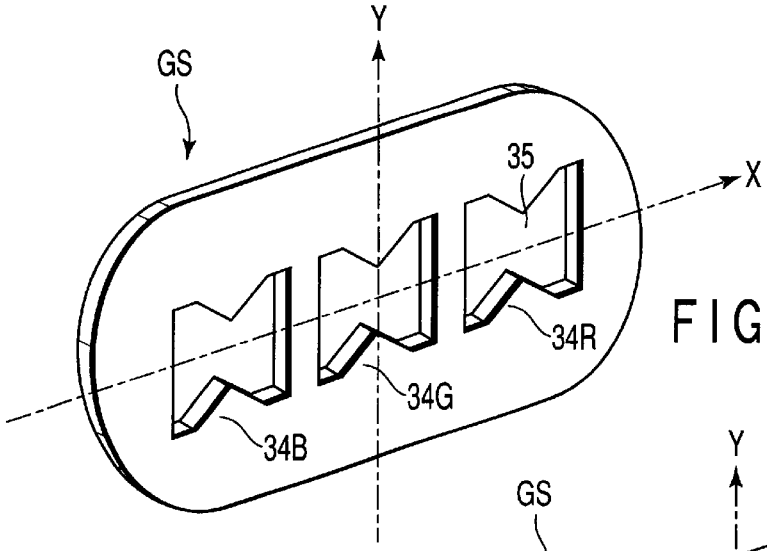
FIGS. 11A and 11B show other shapes of electron beam passage holes formed in additional electrodes applicable to the color CRT apparatus according to Example 2.
Figure 11B:
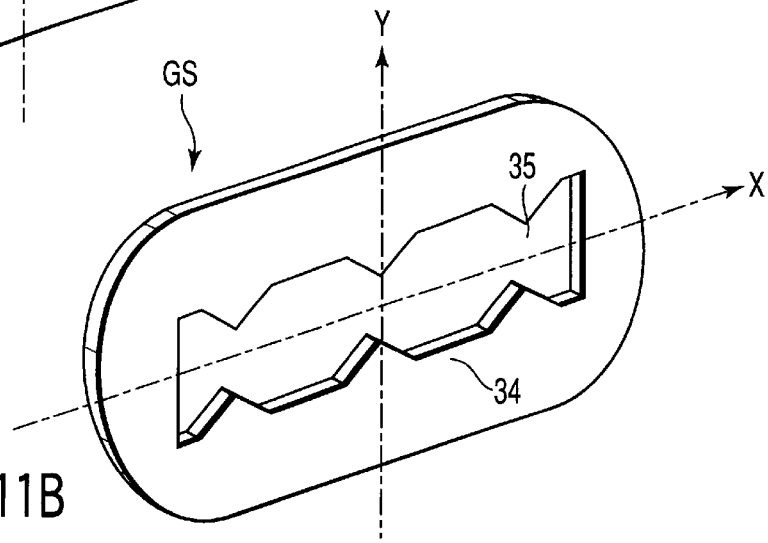

An in-line type color CRT apparatus according to Example 2 has the same structure as the CRT apparatus according to Example 1. An electron gun structure applied to this color CRT apparatus, as shown in FIG. 10, has basically the same structure as that of Example 1 shown in FIG. 8. In particular, in Example 2, the additional electrode Gs between the third grid G3 and fourth grid G4 has horizontally elongated non-circular electron beam passage holes 34B, 34G and 34R each having a long axis in the horizontal direction (X-direction), as shown in FIG. 11A. Alternatively, as shown in FIG. 11B, the additional electrode Gs may have a non-circular electron beam passage hole 34 with a long axis in the horizontal direction, which is shared by the three electron beams. Each of these electron beam passage holes has a waist portion 35 for minimizing the vertical dimension of the region where the electron beam passes. The waist portion 35 contributes to the formation of the electron lens acting on the electron beam passing through the electron beam passage hole 34.

Figure 12:
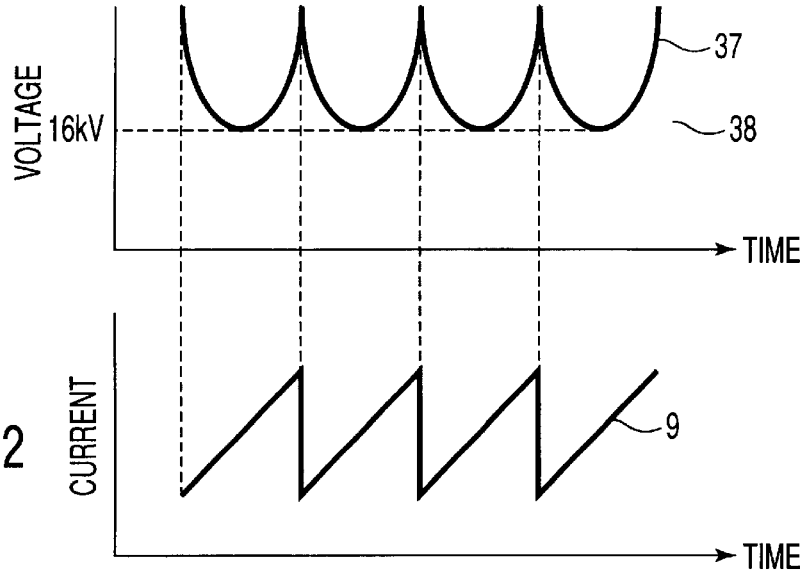
FIG. 12 shows a relationship between a dynamic voltage applied to the additional electrode of the color CRT apparatus according to Example 2, and a deflection current applied to a deflection yoke.
Figure 13:
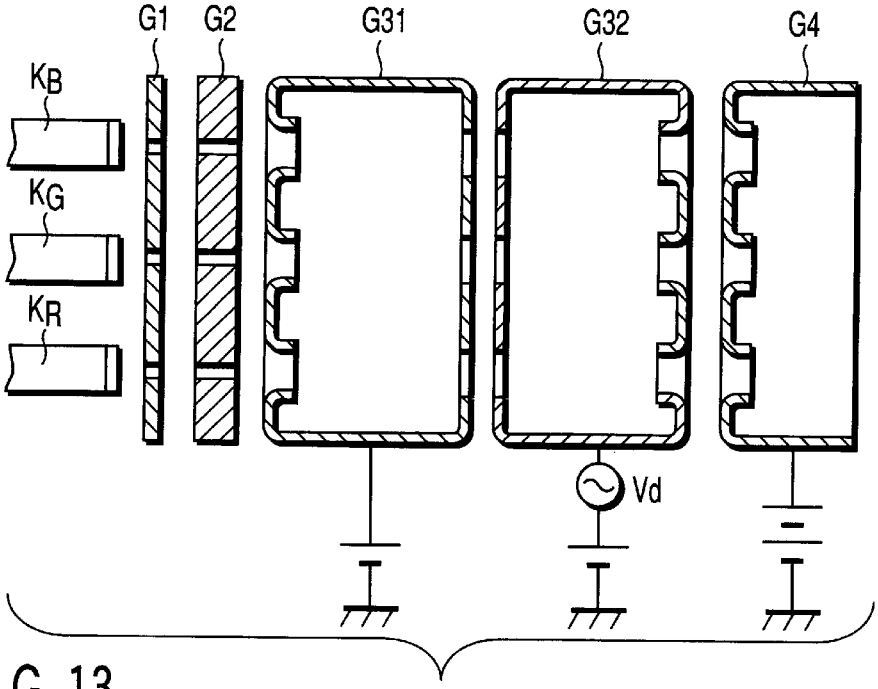
FIG. 13 PRIOR ART
FIG. 13 shows the structure of an electron gun structure in a conventional color CRT apparatus.
Figure 14A:
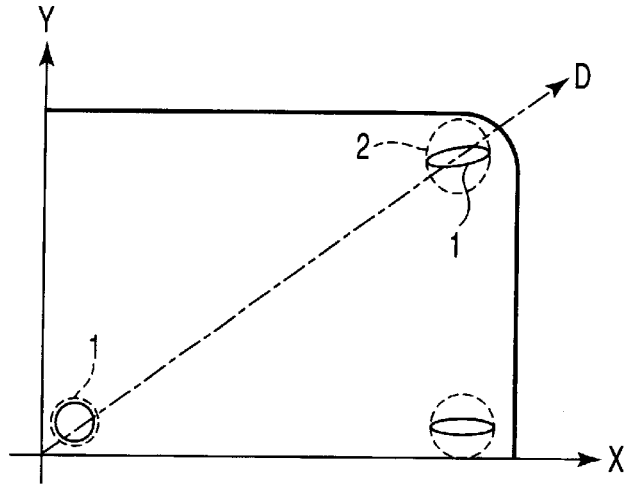
FIG. 14A PRIOR ART
FIG. 14A shows the shape of a beam spot on a phosphor screen of a conventional self-convergence in-line type color CRT apparatus.
Figure 14B:
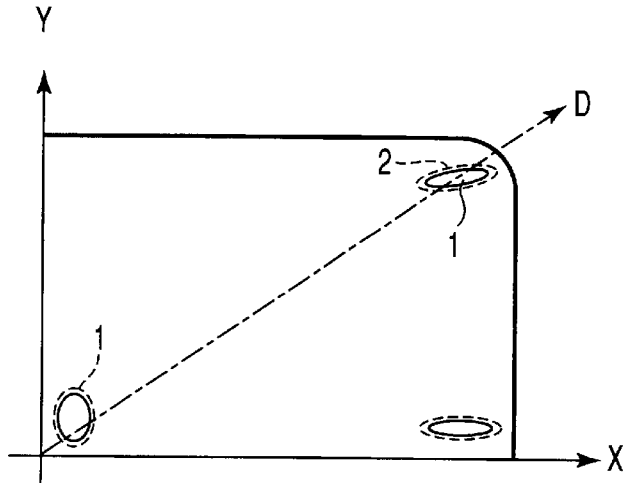
FIG. 14B PRIOR ART
FIG. 14B shows the shape of a beam spot on a phosphor screen where an electron gun structure according to a BPF type ADC&F system is adopted.
Figure 15A:
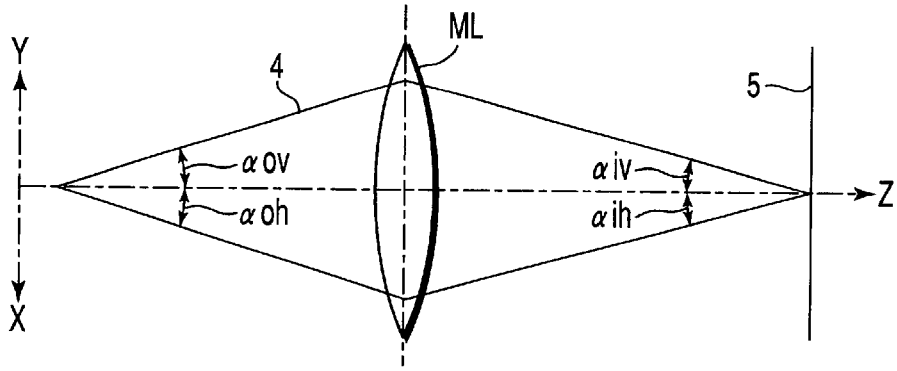
FIG. 15A PRIOR ART
FIG. 15A shows an optical model at a time of non-deflection in a conventional self-convergence in-line type color CRT apparatus.
Figure 15B:
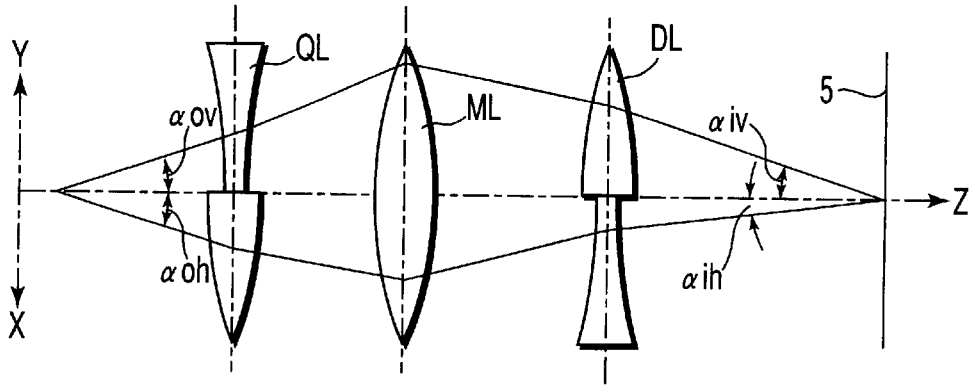
FIG. 15B PRIOR ART
FIG. 15B shows an optical model at a time of deflection in the conventional self-convergence in-line type color CRT apparatus.

In the electron gun structure 29 with the above-described structure, voltages equal to those in Example 1 are applied to the cathodes K, first grid G1, second grid G2, third grid G3 and fourth grid G4. A dynamic voltage 38, which is obtained by superimposing a parabolically variable AC voltage component 37 upon a DC voltage of about 16 kV, as shown in FIG. 12, is applied to the additional electrode Gs. The AC voltage component 37 is synchronized with a sawtooth deflection current 9 and increases in a parabolic fashion in accordance with an increase in the degree of deflection of the electron beam.

Figure 19:
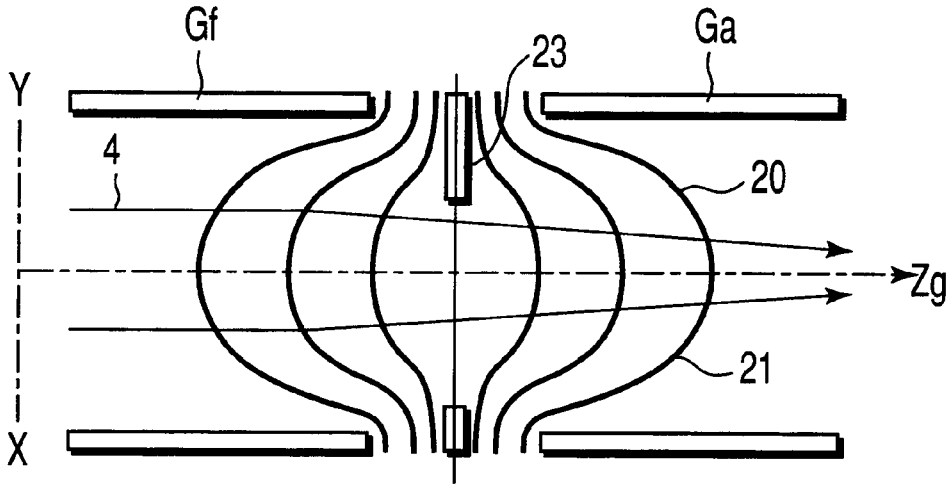
FIG. 19 shows an electric field produced in a case where the additional electrode in Example 2 is provided with waist portions which minimize horizontal dimensions of electron beam passage holes in the additional electrode.

In this electron gun structure, at the time of non-deflection, the main lens is formed between the third grid G3 and fourth grid G4 by an electric field as shown in FIG. 19, and thus it has not astigmatism. Accordingly, each electron beam is focused in the horizontal and vertical directions with the same focusing force. Therefore, each electron beam is focused at the center of the phosphor screen so as to have a substantially circular beam spot.

At the time of deflection, the dynamic voltage 10 applied to the third grid G3 increases as the amount of deflection of the electron beam increases, and also the dynamic voltage 38 applied to the additional electrode Gs increases. Thus, compared to the time of non-deflection, the value expressed by the formula below increases:

[(application voltage to the additional electrode)−(application voltage to the third electrode)]/[(application voltage to the fourth electrode)−(application voltage to the third electrode)].

Figure 20:
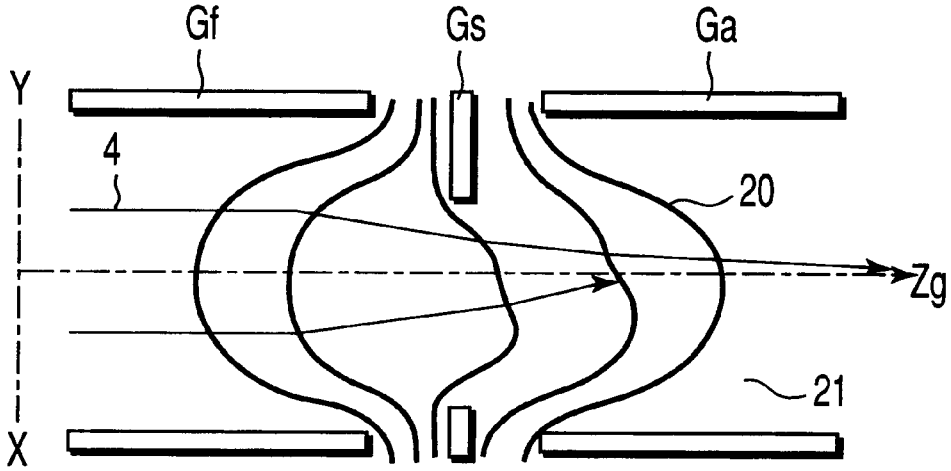
FIG. 20 shows an electric field produced in a case where an application voltage to the additional electrode shown in FIG. 19 is decreased to less than 16 kV.

In this case, since each electron beam passage hole in the additional electrode Gs has the waist portion, the main lens is formed by the electric field as shown in FIG. 20. Accordingly, the main lens has astigmatism. Specifically, an aperture lens (quadrupole lens) having a focusing function in the horizontal direction and a divergence function in the vertical direction is formed within the main lens. At the same time, a potential difference between the third grid G3 and fourth grid G4 decreases. Thereby, the horizontal focusing force and vertical focusing force of the main lens are decreased.

The main lens is constructed such that the horizontal focusing force intensified by the waist portion of additional electrode Gs and the horizontal focusing force weakened by the decrease in potential difference between the third grid G3 and fourth grid G4 may cancel each other. Thereby, like Example 1, each electron beam can optimally focused at a peripheral portion of the phosphor screen 5. Moreover, with the astigmatism possessed by the main lens, the oval shape of the beam spot can be improved.

Where the main lens is formed by the third grid G3 and fourth grid G4 as an electron lens having a stronger focusing force in the horizontal direction than in the vertical direction, the same advantage can be obtained by setting, at the time of non-deflection, the application voltage to the additional electrode Gs to be higher than 16 kV (that is, by applying a potential, which is higher than a potential at the geometrical center of the main lens, to the additional electrode Gs).

As has been described above, the electron gun structure applied to the color CRT apparatus has the main lens for ultimately focusing the electron beams on the phosphor screen. The main lens is formed by the focus electrode disposed on the cathode side, the anode electrode disposed on the phosphor screen side, and the additional electrode disposed between the focus electrode and the anode electrode. The additional electrode is disposed at the geometrical center of the main lens. The additional electrode has the non-circular electron beam passage hole having the waist portion for minimizing the horizontal or vertical dimension of the region where the electron beam passes. The main lens has an astigmatism which dynamically varies in accordance with an increase in the amount of deflection of the electron beam. The astigmatism increases as the amount of deflection of the electron beam increases. The main lens with the astigmatism has a focusing function in the horizontal direction and a divergence function in the vertical direction. Accordingly, horizontal deformation of the beam spot at a peripheral portion of the phosphor screen can be decreased. Therefore, the beam spot can optimally be focused over the entire phosphor screen. Furthermore, the color CRT apparatus capable of displaying a high-quality image, while reducing an oval deformation of a beam spot, can be constructed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode-ray tube apparatus comprising:

an electron gun structure having a plurality of electrodes for constituting a plurality of electron lenses including a main lens for focusing an electron beam on a phosphor screen; and a deflection yoke for producing deflection magnetic fields for deflecting the electron beam emitted from the electron gun structure in a horizontal direction and a vertical direction, wherein an electron beam passage hole formed in at least one of the electrodes constituting the main lens has a waist portion substantially acting on formation of the electron lenses, the waist portion minimizing a horizontal dimension of a region where the electron beam passes.

2. A color cathode-ray tube apparatus comprising:

an electron gun structure having a plurality of electrodes for constituting a plurality of electron lenses including a main lens for focusing three electron beams on a phosphor screen, the three electron beams being arranged in line in a horizontal direction; and a deflection yoke for producing deflection magnetic fields for deflecting the three electron beams emitted from the electron gun structure in the horizontal direction and a vertical direction, wherein the main lens comprises a focus electrode, an anode electrode, at least one additional electrode disposed between the focus electrode and the anode electrode, and voltage application means for applying to the additional electrode a voltage which is higher than a voltage applied to the focus electrode and lower than a voltage applied to the anode electrode, and an electron beam passage hole formed in the additional electrode has a waist portion substantially acting on formation of the electron lenses, the waist portion minimizing a horizontal dimension of a region where the electron beam passes, and a value S, which is given by $S$=[(application voltage to the additional electrode)−(application voltage to the focus electrode)]/[(application voltage to the anode electrode)−(application voltage to the focus electrode)], varies in synchronism with deflection of the three electron beams by the deflection yoke.

3. A color cathode-ray tube apparatus according to claim 2, wherein the value S decreases as the amount of deflection of the three electron beams increase.

4. A color cathode-ray tube apparatus according to claim 2, wherein the value S increases as the amount of deflection of the three electron beams increase.

5. A color cathode-ray tube apparatus according to claim 2, wherein a vertical focusing function of the main lens becomes weaker than a horizontal focusing function thereof as the amount of deflection of the three electron beams increase.

6. A color cathode-ray tube apparatus comprising:

an electron gun structure having a plurality of electrodes for constituting a plurality of electron lenses including a main lens for focusing an electron beam on a phosphor screen; and a deflection yoke for producing deflection magnetic fields for deflecting the electron beam emitted from the electron gun structure in a horizontal direction and a vertical direction, wherein an electron beam passage hole formed in at least one of the electrodes constituting the main lens has a waist portion substantially acting on formation of the electron lenses, the waist portion minimizing a vertical dimension of a region where the electron beam passes.

7. A color cathode-ray tube apparatus comprising:

an electron gun structure having a plurality of electrodes for constituting a plurality of electron lenses including a main lens for focusing three electron beams on a phosphor screen, the three electron beams being arranged in line in a horizontal direction; and a deflection yoke for producing deflection magnetic fields for deflecting the three electron beams emitted from the electron gun structure in the horizontal direction and a vertical direction, wherein the main lens comprises a focus electrode, an anode electrode, at least one additional electrode disposed between the focus electrode and the anode electrode, and voltage application means for applying to the additional electrode a voltage which is higher than a voltage applied to the focus electrode and lower than a voltage applied to the anode electrode, and an electron beam passage hole formed in the additional electrode has a waist portion substantially acting on formation of the electron lenses, the waist portion minimizing a vertical dimension of a region where the electron beam passes, and a value S, which is given by $$S=[(\text{application voltage to the additional electrode})-(\text{application voltage to the focus electrode})]/[(\text{application voltage to the anode electrode})-(\text{application voltage to the focus electrode})],$$

varies in synchronism with deflection of the three electron beams by the deflection yoke.

8. A color cathode-ray tube apparatus according to claim 7, wherein the value S decreases as the amount of deflection of the three electron beams increase.

9. A color cathode-ray tube apparatus according to claim 7, wherein the value S increases as the amount of deflection of the three electron beams increase.

10. A color cathode-ray tube apparatus according to claim 7, wherein a vertical focusing function of the main lens becomes weaker than a horizontal focusing function thereof as the amount of deflection of the three electron beams increase.

* * * * *